US011722239B2

(12) United States Patent
Lee et al.

(10) Patent No.: US 11,722,239 B2
(45) Date of Patent: Aug. 8, 2023

(54) SYSTEM AND METHOD FOR MONITORING WIRELESS COMMUNICATION CHANNEL BY USING COOPERATIVE JAMMING AND SPOOFING

(71) Applicant: Korea University Research and Business Foundation, Seoul (KR)

(72) Inventors: Inkyu Lee, Seoul (KR); Jihwan Moon, Yongin-si (KR)

(73) Assignee: Korea University Research and Business Foundation, Seoul (KR)

( * ) Notice: Subject to any disclaimer, the term of this patent is extended or adjusted under 35 U.S.C. 154(b) by 219 days.

(21) Appl. No.: 17/290,374

(22) PCT Filed: May 21, 2019

(86) PCT No.: PCT/KR2019/006046

§ 371 (c)(1),
(2) Date: Jul. 8, 2021

(87) PCT Pub. No.: WO2020/091170

PCT Pub. Date: May 7, 2020

(65) Prior Publication Data

US 2021/0409146 A1 Dec. 30, 2021

(30) Foreign Application Priority Data

Nov. 2, 2018 (KR) ..... 10-2018-0133536

(51) Int. Cl.
*H04K 3/00* (2006.01)

(52) U.S. Cl.
CPC ..... *H04K 3/65* (2013.01); *H04K 3/825* (2013.01); *H04K 2203/34* (2013.01)

(58) Field of Classification Search
CPC ..... H04K 3/65; H04K 3/825; H04K 2203/34
See application file for complete search history.

(56) References Cited

U.S. PATENT DOCUMENTS 7,764,224 B1 * 7/2010 Anderson ..... G01S 19/215 342/357.27

FOREIGN PATENT DOCUMENTS

KR 10-2005-0101265 A 10/2005
KR 10-2010-0073125 A 7/2010
(Continued)

OTHER PUBLICATIONS

Zeng, Yong et al., "Wireless Information Surveillance via Proactive Eavesdropping with Spoofing Relay," *IEEE Journal of Selected Topics in Signal Processing*, 10, 8, 2016 (pp. 1449-1461).
(Continued)

*Primary Examiner* — Keith Ferguson
(74) *Attorney, Agent, or Firm* — NSIP Law

(57) ABSTRACT

A monitoring system using cooperative jamming and spoofing according to an embodiment of the present disclosure includes a spoofing relay to amplify and relay an illegal signal detected from an illegal transmitter according to a preset amplification coefficient, a cooperative jammer to transmit a jamming signal for changing the quality of a communication channel to an illegal receiver with a preset transmit power, and a monitor to calculate the amplification coefficient and the transmit power so that an information monitoring amount is maximum based on the illegal signal received from the spoofing relay.

10 Claims, 8 Drawing Sheets

(56) References Cited

FOREIGN PATENT DOCUMENTS

| | | | |
|---|---|---|---|
| KR | 10-1403020 | B1 | 6/2014 |
| KR | 10-1791500 | B1 | 10/2017 |
| KR | 10-1884122 | B1 | 8/2018 |

OTHER PUBLICATIONS

Moon, Jihwan, et al., "Proactive Eavesdropping with Full-Duplex Relay and Cooperative Jamming." *IEEE Transactions on Wireless Communications*, vol. 17, No. 10, Oct. 2018 (pp. 6707-6719).
Moon, Jihwan, et al. "Relay-Assisted Proactive Eavesdropping with Cooperative Jamming and Spoofing," *IEEE Transactions on Wireless Communications*, vol. 17, No. 10, Oct. 2018 (pp. 6958-6971).
International Search Report dated Aug. 29, 2019 in counterpart International Patent Application No. PCT/KR2019/006046 (3 pages in English and 3 pages in Korean).

* cited by examiner

SYSTEM AND METHOD FOR MONITORING WIRELESS COMMUNICATION CHANNEL BY USING COOPERATIVE JAMMING AND SPOOFING

TECHNICAL FIELD

The present disclosure relates to a system and method for monitoring a wireless communication channel by using cooperative jamming and spoofing, and more particularly, to a system and method for monitoring a wireless communication channel by using cooperative jamming and spoofing to monitor information transmitted and received between users using wireless communication for malicious purposes.

BACKGROUND ART

With the rapid advance in wireless communication technologies and development of infrastructure, in these days, many users transmit and receive to/from other users in remote areas using wireless communication, and new technologies and services are being developed in conjunction with wireless communication technologies across various technology sectors to improve user convenience.

However, for improper purposes such as cyber terrors or commitment to crimes, some malicious users make bad use of an advantage that it is easy and simple to design an individual communication network for a specific group, and there is an increasing need to monitor wireless communication content between users having malicious purposes.

However, since the existing monitors for monitoring information only serve as receivers, their main downside is that they fail to accurately recover the acquired information when the monitoring channel quality is bad.

Additionally, the existing monitoring systems acquire information via direct communication channels formed between monitors and illegal users, so the illegal users can easily recognize that they are being monitored, and it is impossible to accurately acquire information when the illegal users are located at remote areas far from monitors or shadow zones.

RELATED LITERATURES

Patent Literatures (Patent Literature 1) Korean Patent No. 10-1403020
(Patent Literature 2) Korean Patent No. 10-1791500

DISCLOSURE

Technical Problem

An aspect of the present disclosure provides a system and method for monitoring a wireless communication channel by using cooperative jamming and spoofing in which a spoofing relay and a cooperative jammer are controlled so that the monitoring amount of information is maximum in the process of monitoring an illegal signal transmitted and received between an illegal transmitter and an illegal receiver.

The technical problem of the present disclosure is not limited to the above-mentioned technical problem and other technical problems not mentioned herein will be clearly understood by those skilled in the art from the following description.

Technical Solution

A wireless communication channel monitoring system using cooperative jamming and spoofing to monitor information transmitted and received through a communication channel set between an illegal transmitter and an illegal receiver possessed by users using wireless communication for malicious purposes according to an embodiment of the present disclosure includes a spoofing relay to amplify and relay an illegal signal detected from the illegal transmitter according to a preset amplification coefficient, a cooperative jammer to transmit a jamming signal for changing the quality of the communication channel to the illegal receiver with a preset transmit power, and a monitor to calculate the amplification coefficient and the transmit power so that the monitoring amount of information is maximum based on the illegal signal received from the spoofing relay.

The wireless communication channel monitoring system using cooperative jamming and spoofing may operate in any one mode of a first mode in which the jamming signal is transmitted to the illegal receiver with a maximum possible transmit power and a spoofing signal is transmitted according to the amplification coefficient for reducing a Signal-to-Interference-plus-Noise Ratio (SINR) of the illegal receiver, a second mode in which the jamming signal is transmitted to the illegal receiver with the transmit power that is equal to or less than the maximum transmit power and the spoofing signal is transmitted according to the amplification coefficient for increasing the SINR of the illegal receiver, and a third mode in which the jamming signal is not transmitted to the illegal receiver and the spoofing signal is transmitted according to the amplification coefficient for increasing the SINR of the illegal receiver.

The monitor may calculate the amplification coefficient for each mode and the transmit power for each mode in which the monitoring amount of information acquired by recovering the illegal signal is maximum for each of the first mode, the second mode and the third mode, extract any one mode of the first mode, the second mode and the third mode in which the monitoring amount of information is maximum, and select the amplification coefficient for each mode and the transmit power for each mode calculated in the any one extracted mode as the amplification coefficient and the transmit power in which the monitoring amount of information is maximum.

The monitor may transmit the selected amplification coefficient to the spoofing relay and the selected transmit power to the cooperative jammer, the spoofing relay may change the preset amplification coefficient to the amplification coefficient received from the monitor, and the cooperative jammer may change the preset transmit power to the transmit power received from the monitor.

The wireless communication channel monitoring system using cooperative jamming and spoofing may operate in any one mode of the first mode, the second mode and the third mode according to a result of comparison of a monitoring channel capacity set between the spoofing relay and the monitor and a transmission speed of the illegal transmitter determined by the SINR of the illegal receiver.

The wireless communication channel monitoring system using cooperative jamming and spoofing may operate in the first mode for reducing the SINR of the illegal receiver to reduce the transmission speed of the illegal transmitter when the monitoring channel capacity is found smaller than the transmission speed, and operate in any one mode of the second mode and the third mode for increasing the SINR of the illegal receiver to increase the transmission speed of the illegal transmitter when the monitoring channel capacity is found greater than the transmission speed.

In addition, a wireless communication channel monitoring method using cooperative jamming and spoofing according to an embodiment of the present disclosure using a wireless communication channel monitoring system using cooperative jamming and spoofing, including a spoofing relay, a cooperative jammer and a monitor includes calculating, by the monitor, an amplification coefficient of the spoofing relay for each mode and a transmit power of the cooperative jammer for each mode in which a monitoring amount of information is maximum for each operation mode of the wireless communication channel monitoring system using cooperative jamming and spoofing, extracting, by the monitor, any one operation mode in which the monitoring amount of information is maximum, selecting the amplification coefficient for each mode and the transmit power for each mode calculated in the any one extracted operation mode as the amplification coefficient and the transmit power in which the monitoring amount of information is maximum, and transmitting the selected amplification coefficient to the spoofing relay and the selected transmit power to the cooperative jammer.

The wireless communication channel monitoring system using cooperative jamming and spoofing may operate in any one mode of a first mode in which the jamming signal is transmitted to the illegal receiver with a maximum possible transmit power and a spoofing signal is transmitted according to the amplification coefficient for reducing a SINR of the illegal receiver, a second mode in which the jamming signal is transmitted to the illegal receiver with the transmit power that is equal to or less than the maximum transmit power and the spoofing signal is transmitted according to the amplification coefficient for increasing the SINR of the illegal receiver, and a third mode in which the jamming signal is not transmitted to the illegal receiver and the spoofing signal is transmitted according to the amplification coefficient for increasing the SINR of the illegal receiver.

Calculating, by the monitor, the amplification coefficient of the spoofing relay for each mode and the transmit power of the cooperative jammer for each mode in which the monitoring amount of information is maximum for each operation mode of the wireless communication channel monitoring system using cooperative jamming and spoofing may include calculating the amplification coefficient for each mode and the transmit power for each mode in which the monitoring amount of information acquired by recovering the illegal signal is maximum for each of the first mode, the second mode and the third mode, extracting any one mode of the first mode, the second mode and the third mode in which the monitoring amount of information is maximum, and selecting the amplification coefficient for each mode and the transmit power for each mode calculated in the any one extracted mode as the amplification coefficient and the transmit power in which the monitoring amount of information is maximum.

The wireless communication channel monitoring method using cooperative jamming and spoofing may further include predicting a channel set between the spoofing relay, the cooperative jammer and the monitor, and sharing the channel and a jamming signal generated in the cooperative jammer.

Advantageous Effects

According to an aspect of the present disclosure described above, it is possible to proactively monitor an illegal signal transmitted and received between illegal users by using the spoofing relay and the cooperative jammer, and maximize the information monitoring amount by changing the amplification coefficient of the spoofing relay and the transmit power of the cooperative jammer in real time depending on the result of comparison between the monitoring channel capacity and the transmission speed of the illegal transmitter.

BEST MODE

Figure 1:
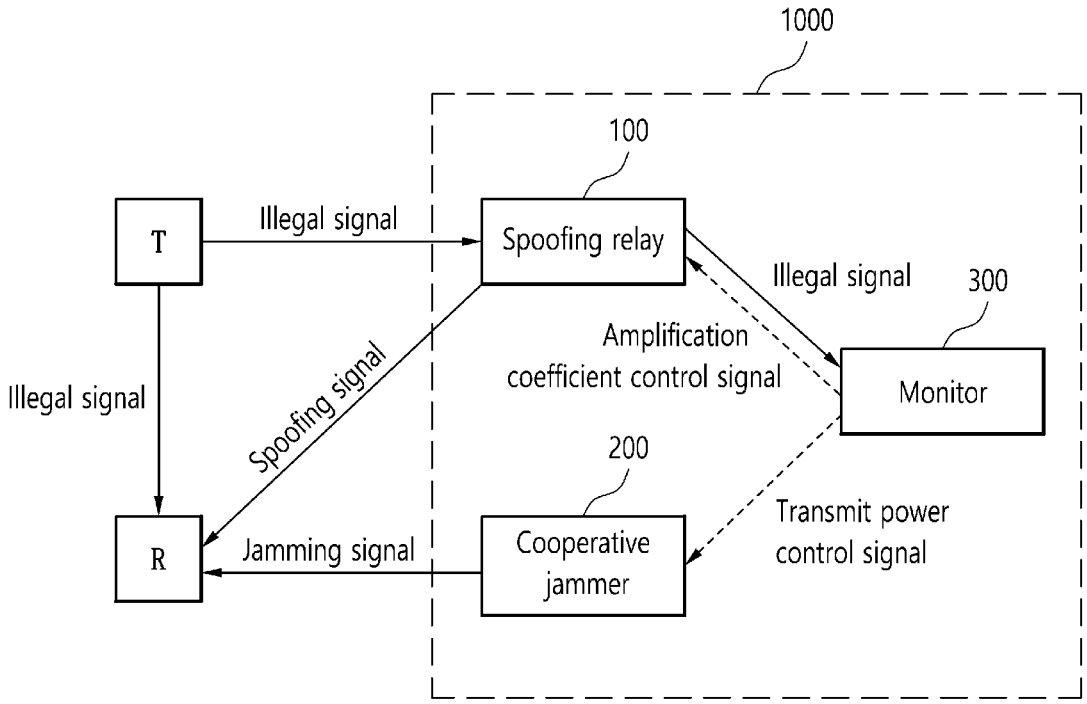
FIG. 1 is a conceptual diagram showing a schematic architecture of a wireless communication channel monitoring system using cooperative jamming and spoofing according to an embodiment of the present disclosure.

The following detailed description of the present disclosure is made with reference to the accompanying drawings, in which particular embodiments for practicing the present disclosure are shown for illustration purposes. These embodiments are described in sufficiently detail for those skilled in the art to practice the present disclosure. It should be understood that various embodiments of the present disclosure are different but do not need to be mutually exclusive. For example, particular shapes, structures and features described herein in connection with one embodiment may be embodied in other embodiment without departing from the spirit and scope of the present disclosure. It should be further understood that changes may be made to the positions or placement of individual elements in each disclosed embodiment without departing from the spirit and scope of the present disclosure. Accordingly, the following detailed description is not intended to be taken in limiting senses, and the scope of the present disclosure, if appropriately described, is only defined by the appended claims along with the full scope of equivalents to which such claims are entitled. In the drawings, similar reference signs denote same or similar functions in many aspects.

Hereinafter, the preferred embodiments of the present disclosure will be described in more detail with reference to the accompanying drawings.

FIG. 1 is a conceptual diagram showing a schematic architecture of a wireless communication channel monitoring system using cooperative jamming and spoofing according to an embodiment of the present disclosure.

To prevent the intent of users (hereinafter illegal users) using wireless communication for malicious purposes such as cyber terrors or commitment to crimes, the wireless communication channel monitoring system 1000 using cooperative jamming and spoofing according to the present disclosure may monitor information transmitted and received between the illegal users via a wireless communication network. To this end, the wireless communication channel monitoring system 1000 using cooperative jamming and spoofing according to the present disclosure may acquire information transmitted and received through a wireless communication channel set between an illegal transmitter T and an illegal receiver R provided on the side of the illegal users.

In particular, the wireless communication channel monitoring system 1000 using cooperative jamming and spoofing according to the present disclosure may enable a monitor 300 to acquire an illegal signal transmitted from the illegal transmitter T through a spoofing relay 100 in the absence of a direct communication channel between the illegal transmitter T and the monitor 300 to prevent the illegal users from recognizing that information transmitted and received through the wireless communication channel set between the illegal transmitter T and the illegal receiver R is being monitored.

In this process, the wireless communication channel monitoring system 1000 using cooperative jamming and spoofing according to the present disclosure may change the illegal signal amplification coefficient of the spoofing relay 100 and the transmit power of a cooperative jammer 200 in real time to maximize the receiving rate of the illegal signal acquired at the monitor 300.

That is, the wireless communication channel monitoring system 1000 using cooperative jamming and spoofing according to the present disclosure may favorably adjust the communication channel quality to the monitoring by changing the illegal signal amplification coefficient of the spoofing relay 100 and the transmit power of the cooperative jammer 200, thereby maximizing the amount of information acquired from the illegal signal.

In detail, the wireless communication channel monitoring system 1000 using cooperative jamming and spoofing according to an embodiment of the present disclosure may include the spoofing relay 100, the cooperative jammer 200 and the monitor 300.

The spoofing relay 100 may be a communication relay positioned between the illegal transmitter T and the monitor 300 to detect the illegal signal transmitted from the illegal transmitter T and transmit it to the monitor 300.

As described above, the wireless communication channel monitoring system 1000 using cooperative jamming and spoofing according to the present disclosure may enable the monitor 300 to acquire the illegal signal transmitted from the illegal transmitter T through the spoofing relay 100 in the absence of a direct communication channel between the illegal transmitter T and the monitor 300 to prevent the illegal users from recognizing that information transmitted and received through the wireless communication channel set between the illegal transmitter T and the illegal receiver R is being monitored.

To this end, the spoofing relay 100 may adjust the location to place the illegal transmitter T within the communication range of the spoofing relay 100. For convenience of description, the following description is made under the assumption that only one spoofing relay 100 is positioned between the illegal transmitter T and the monitor 300, and the spoofing relay 100 directly relays the illegal signal detected from the illegal transmitter T to the monitor 300. However, the number of spoofing relays 100 is not limited to one, and in some cases, there may be multiple spoofing relays 100. In this case, the multiple spoofing relays 100 may form a relay network and when any one spoofing relay 100 receives the illegal signal from the illegal transmitter T, the corresponding spoofing relay 100 may transmit the illegal signal to its adjacent spoofing relay 100 to transmit the illegal signal to a target node, i.e., the monitor 300.

The spoofing relay 100 may perform wireless communication in Amplify-and-Forward (AF) Full-Duplex (FD) mode.

In detail, when the spoofing relay 100 receives the illegal signal from the illegal transmitter T, the spoofing relay 100 may amplify the illegal signal according to a preset amplification coefficient and transmit it to the monitor 300 in Amplify-and-Forward (AF) transmission mode.

Additionally, the spoofing relay 100 may perform wireless communication in Full-Duplex (FD) mode, and may transmit the received illegal signal to the monitor 300, and at the same time, generate a spoofing signal and transmit it to the illegal receiver R.

That is, when the spoofing relay 100 relays the signal received from the illegal transmitter T to the monitor 300, not only the monitor 300 but also the illegal receiver R inevitably receive the corresponding signal. Using this property, the spoofing relay 100 may manipulate and transmit the intercepted signal in a manner of degrading or improving the decoding quality of the illegal receiver R, if necessary. This information manipulation and transmission technology is referred to as spoofing, and the spoofing relay 100 may generate the spoofing signal for changing the decoding quality of the illegal receiver R and transmit it to the illegal receiver R using the above-described spoofing technology.

The cooperative jammer 200 may generate a jamming signal for changing the communication channel quality between the illegal transmitter T and the illegal receiver R and transmit it to the illegal receiver R.

The jamming signal is a signal including a sort of noise component that is transmitted to the receiver to obscure the content of information included in the signal received at the receiver, and a Signal-to-Interference-plus-Noise Ratio (SINR) of the illegal receiver R may be determined according to the type and signal strength the jamming signal received from the cooperative jammer 200.

As described below, the illegal transmitter T determines the transmission speed of the illegal signal according to the SINR of the illegal receiver R, and the cooperative jammer 200 may transmit the jamming signal for creating a favorable environment for the monitoring of the illegal signal to the illegal receiver R by increasing or reducing the transmission speed of the illegal transmitter T.

The monitor 300 is a terminal provided on the side of a person who monitors the illegal user, and may include a desktop, a smartphone, a tablet PC, a laptop and a server capable of communicating with other device and data input/output and processing.

The monitor 300 may monitor the illegal signal transmitted from the illegal transmitter T by using the spoofing relay 100 and the cooperative jammer 200. In detail, the monitor 300 may receive the illegal signal relayed from the spoofing relay 100. The monitor 300 may acquire information included in the illegal signal by recovering the received illegal signal.

In this process, the monitor 300 may change the SINR of the illegal receiver R by using the spoofing relay 100 and the cooperative jammer 200 so that the amount of information recovered and acquired from the illegal signal is maximum. It will be described with reference to FIGS. 2 to 4 together.

Figure 3A:
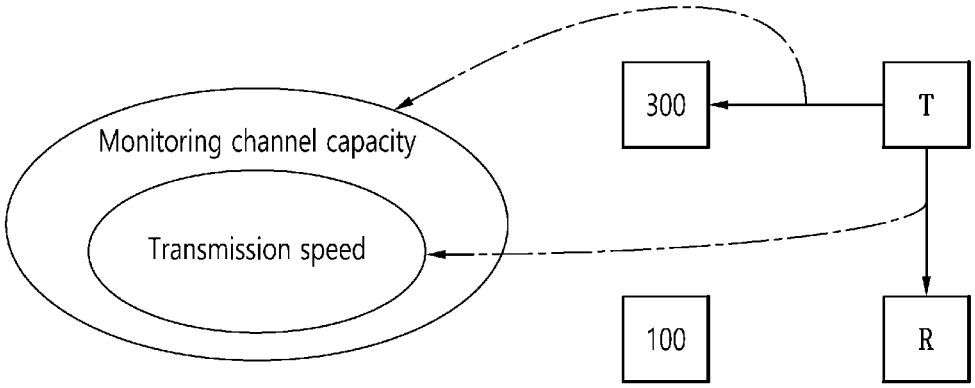
Figure 3B:
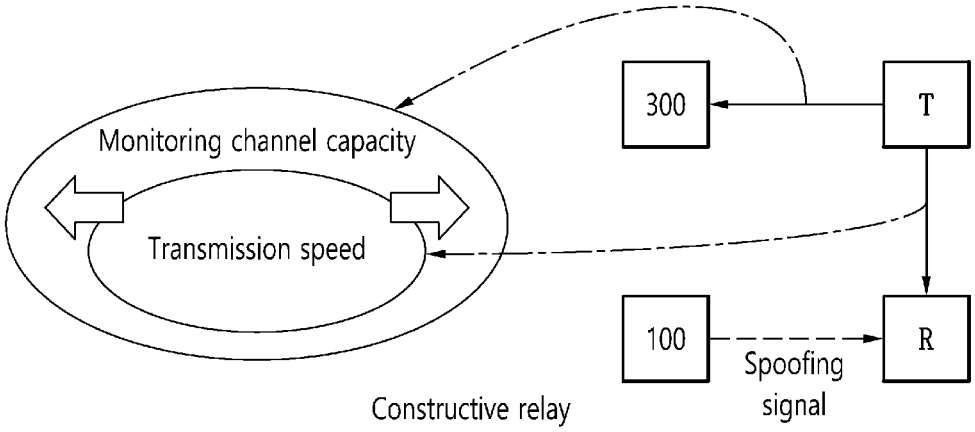
Figure 4:
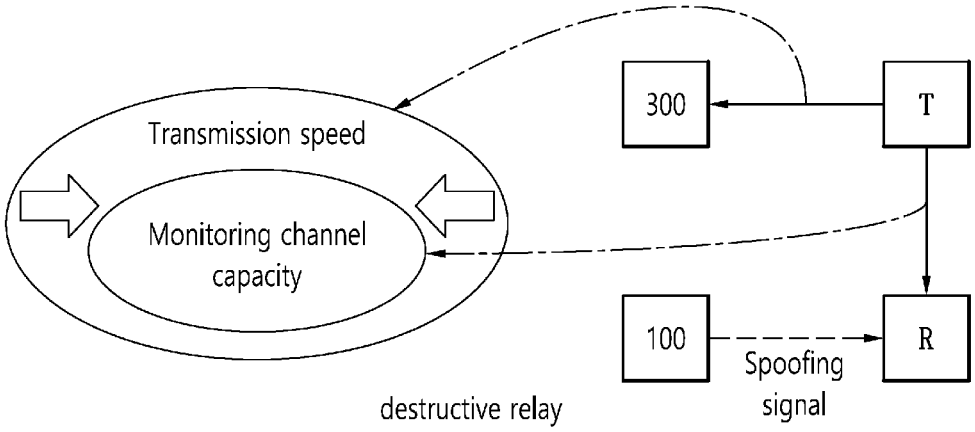

FIGS. 2 to 4 are conceptual diagrams showing examples in which the monitor 300 changes the transmission speed of the illegal transmitter T using the SINR of the illegal receiver R so that the acquisition amount of information included in the illegal signal is maximum.

In general, the illegal transmitter T which performs wireless communication with the illegal receiver R may adjust the transmission speed according to the communication channel quality index of the illegal receiver R. For example, the illegal transmitter T may receive information associated with the SINR of the illegal receiver R, and when the SINR of the illegal receiver R is found low, the illegal transmitter T may reduce the transmission speed of the illegal signal to allow the illegal receiver R to recover only a small amount of signals. In contrast, when the SINR of the illegal receiver R is found high, the illegal transmitter T may increase the transmission rate of the illegal signal, namely, the transmission speed to allow the illegal receiver R to recover a large amount of signals.

That is, for the monitor 300 to accurately recover the information included in the received signal, the communication capacity between the illegal transmitter T and the monitor 300 should be equal to or greater than the transmission speed used in the illegal transmitter T. In this instance, in the case of the existing monitoring system, since the monitor 300 only serves as a receiver, it is impossible to accurately recover the information included in the illegal signal at low monitoring channel capacity (quality).

To overcome this problem, the monitor 300 according to the present disclosure may proactively change the current communication environment to a favorable environment for the monitoring of the illegal signal, namely, an environment in which the information monitoring amount is maximum, by changing the SINR of the illegal receiver R by using the spoofing relay 100 and the cooperative jammer 200.

Figure 2A:
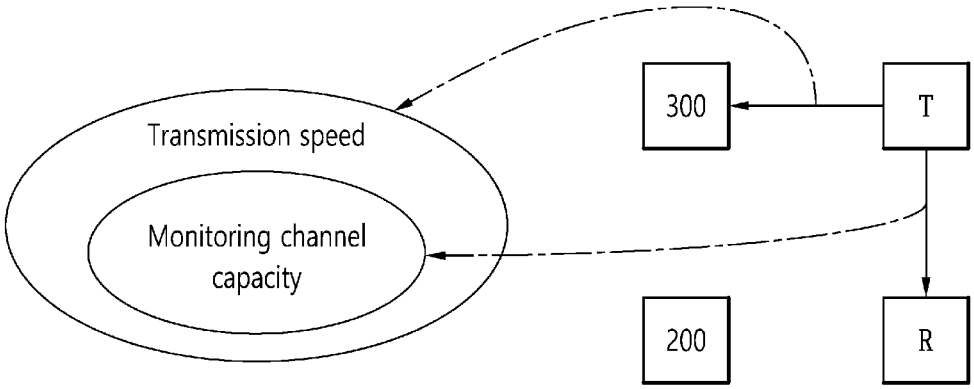
FIGS. 2 to 4 are conceptual diagrams showing examples in which the monitoring system of FIG. 1 changes the transmission speed of an illegal transmitter so that the acquisition amount of information included in an illegal signal is maximum.
Figure 2B:
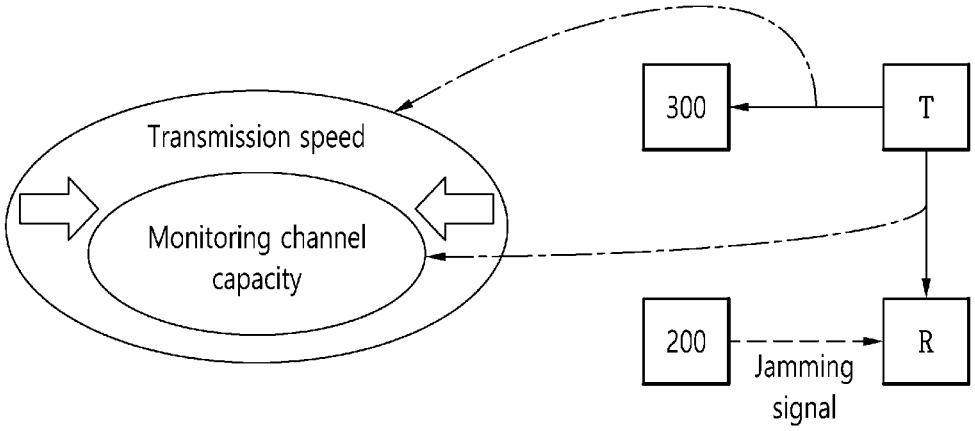

First, as shown in FIG. 2A, when it is impossible to accurately recover information from the received illegal signal due to the capacity of the monitoring channel that is lower than the transmission speed of the illegal transmitter T, the monitor 300 may reduce the SINR of the illegal receiver R by using the jamming signal of the cooperative jammer 200 as shown in FIG. 2B. In this case, the illegal transmitter T may determine the quality degradation of the communication channel set between the illegal transmitter T and the illegal receiver R and transmit the illegal signal at the reduced transmission speed of the illegal signal. Accordingly, the transmission speed of the illegal transmitter T is lower than the monitoring channel capacity and the monitor 300 may accurately recover the information included in the illegal signal.

In another example, as shown in FIG. 3A, when it is determined that it is possible to accurately recover the information included in the illegal signal due to the monitoring channel capacity that is higher than the transmission speed of the illegal transmitter T, the monitor 300 may intentionally increase the SINR of the illegal receiver R by using the spoofing relay 100 as shown in FIG. 3B.

In this instance, a technique that the spoofing relay 100 transmits the spoofing signal for increasing the SINR of the illegal receiver R is referred to as 'constructive relaying'. The monitor 300 may monitor a larger amount of information than the existing passive monitoring method through this proactive monitoring process.

Meanwhile, the spoofing relay 100 may be used even when it is impossible to accurately recover the intercepted information due to the eavesdropping channel capacity that is lower than the transmission speed of the illegal transmitter as shown in FIG. 2A. In detail, as shown in FIG. 4, the monitor 300 may transmit the spoofing signal of the spoofing relay 100 to the illegal receiver R to reduce the SINR of the illegal receiver and this signal manipulation is referred to as 'destructive relaying'.

As described above, when the monitoring channel capacity is lower than the transmission speed, the monitor 300 may recover the information without omission or distortion of the illegal signal by reducing the transmission speed of the illegal transmitter T through destructive relaying of the cooperative jammer 200 or the spoofing relay 100, and when the monitoring channel capacity is greater than the transmission speed, the monitor 300 may increase the amount of recovered information by improving the transmission speed of the illegal transmitter T through constructive relaying of the spoofing relay 100.

In this process, the monitor 300 may calculate the optimal value of the amplification coefficient of the spoofing relay 100 and the transmit power the cooperative jammer 200 for the maximum monitoring amount of information acquired by recovering the received illegal signal. In other words, the monitor 300 may calculate the amplification coefficient of the spoofing relay 100 and the transmit power of the cooperative jammer 200 so that the information monitoring amount is maximum.

To this end, the monitor 300 may calculate the SINR of the monitor 300 and the SINR of the illegal receiver R, and calculate the amplification coefficient of the spoofing relay 100 and the transmit power of the cooperative jammer 200 so that the monitoring amount of information acquired from the illegal signal is maximum based on the calculated SINRs.

Hereinafter, a process of calculating, by the monitor 300, the amplification coefficient of the spoofing relay 100 and the transmit power of the cooperative jammer 200 so that the information monitoring amount is maximum will be described in detail.

First, the illegal signal received at the spoofing relay 100 from the illegal transmitter T is as below.

$$y_S = h_{TS}x_T + h_{SS}x_S + z_S \quad \text{[Equation 1]}$$

Here, $y_S$ denotes the illegal signal received at the spoofing relay 100, $h_{TS}$ denotes a channel value between the illegal transmitter T and the spoofing relay 100, $x_T$ denotes the transmitted signal of the illegal transmitter T, $h_{SS}$ denotes a channel value between the spoofing relays 100, $x_S$ denotes the transmitted signal of the spoofing relay 100, and $z_S$ denotes white noise of the spoofing relay 100.

Additionally, when the spoofing relay 100 amplifies the received illegal signal $y_S$ according to the amplification coefficient and relays it, the signal may be represented as below.

$$x_S = G_S y_S = G_S(h_{TS}x_T + h_{SS}x_S + z_S) \text{ or} \quad \text{[Equation 2]}$$

$$x_S = \frac{G_S h_{TS}}{(1 - G_S h_{SS})} x_T + \frac{G_S}{(1 - G_S h_{SS})} z_S$$

Here, $x_S$ denotes the signal relayed by the spoofing relay 100, and $G_S$ denotes the amplification coefficient of the spoofing relay 100.

Accordingly, the illegal signal $y_M$ received at the monitor 300 by the relay of the spoofing relay 100 may be represented as below.

$$y_M = h_{SM}x_S + z_M \quad \text{[Equation 3]}$$

$$= h_{SM}\underbrace{\frac{G_S h_{TS}}{(1 - G_S h_{SS})}}_{Desired} x_T + h_{SM}\frac{G_S}{(1 - G_S h_{SS})}$$

-continued $$z_S + z_M$$

$$y_M = h_{SM}x_S + z_M$$

$$= h_{SM}\underbrace{\frac{G_S h_{TS}}{(1 - G_S h_{SS})}}_{Desired}x_T + h_{SM}\frac{G_S}{(1 - G_S h_{SS})}$$

$$z_S + z_M$$

In the above Equation 3, the first term (Desired) includes the information included in the illegal signal.

On the other hand, the illegal signal $y_R$ received at the illegal receiver R from the illegal transmitter T is as below.

$$y_R = h_{TR}x_T + h_{SR}x_S + h_{JR}x_J + z_R \quad \text{[Equation 4]}$$

$$= \left(h_{TR} + h_{SR}\underbrace{\frac{G_S h_{TS}}{(1 - G_S h_{SS})}}_{Desired}\right)x_T + h_{SR}\frac{G_S}{(1 - G_S h_{SS})}$$

$$z_S + h_{JR}x_J + z_R$$

Here, $h_{TR}$ denotes a channel value between the illegal transmitter T and the illegal receiver R, $h_{SR}$ denotes a channel value between the spoofing relay 100 and the illegal receiver R, $h_{JR}$ denotes a channel value between the cooperative jammer 200 and the illegal receiver R, $x_S$ denotes the spoofing signal, $x_J$ denotes the jamming signal, and $z_R$ denotes the illegal receiver R.

Likewise to the above-described Equation 3, the first term (Desired) includes the information included in the illegal signal.

Accordingly, the SINR of the monitor 300 may be represented as the following Equation 5, and the SINR of the illegal receiver R may be represented as the following Equation 6.

$$\gamma_M(G_S) = \frac{\left|h_{SM}\frac{G_S h_{TS}}{(1 - Gh_{SS})}\right|^2 P_T}{\left|h_{SM}\frac{G_S}{(1 - G_S h_{SS})}\right|^2 \sigma_S^2 + \sigma_M^2} \quad \text{[Equation 5]}$$

$$\gamma_R(G_S, P_J) = \frac{\left|h_{TR} + h_{SR}\frac{G_S h_{TS}}{(1 - G_S h_{SS})}\right|^2 P_T}{\left|h_{SR}\frac{G_S}{(1 - G_S h_{SS})}\right|^2 \sigma_S^2 + |h_{JR}|^2 P_J + \sigma_R^2} \quad \text{[Equation 6]}$$

Hereinafter, for convenience of description, the SINR of the monitor 300 is defined as a first SINR, and the SINR of the illegal receiver R is defined as a second SINR.

In this instance, the monitor 300 may maximize the monitoring amount of information recovered from the illegal signal by optimizing the amplification coefficient of the spoofing relay 100 and the transmit power of the cooperative jammer 200 using the following Equation.

$$(P): \max_{G_S, P_J} W\log_2(1 + \gamma_R(G_S, P_J)) \quad \text{[Equation 7]}$$

$$\text{s.t. } \gamma_M(G_S) \geq \gamma_R(G_S, P_J)$$

-continued $$\gamma_M(G_S) \geq \overline{\gamma}_M$$

$$\left|\frac{G_S h_{TS}}{(1 - G_S h_{SS})}\right|^2 P_T + \left|\frac{G_S}{(1 - G_S h_{SS})}\right|^2 \sigma_S^2 \leq \overline{P}_S$$

$$0 \leq P_J \leq \overline{P}_J$$

Here, $P_J$ is the transmit power of the cooperative jammer 200, $\gamma_M(G_S)$ is the SINR of the monitor 300 (the first SINR), $\gamma_R(G_S, P_J)$ is the SINR of the illegal receiver R (the second SINR), and $h_{TS}$ is the channel value between the illegal transmitter T and the spoofing relay 100.

Additionally, the first conditional expression is a conditional expression indicating that the monitoring channel capacity $\gamma_M(G_S)$ should be higher than the transmission speed of the illegal transmitter R, the second conditional expression is a conditional expression representing a minimum required SINR value for the monitor 300 to recover the monitored information, and the third and fourth conditional expressions are equations for the upper limit of the transmit power of the spoofing relay 100 and the cooperative jammer 200 respectively.

It can be seen from Equation 7 that the substantial amplification coefficient of the spoofing relay 100 is $$\frac{G_S}{(1 - G_S h_{SS})},$$

and when it is defined as $\Omega_S e^{j\theta_S}$ (where $\Omega_S$ is the magnitude of the amplification coefficient and $\theta_S$ is the phase of the amplification coefficient), the first SINR and the second SINR may be represented as the magnitude $\Omega_S$ and phase $\theta_S$ of the amplification coefficient of the spoofing relay 100. It is represented as the following equation.

$$\gamma_M(\Omega_S) = \frac{|h_{SM}h_{TS}|^2\Omega_S^2 P_T}{|h_{SM}|^2\Omega_S^2\sigma_S^2 + \sigma_M^2} \quad \text{[Equation 8]}$$

$$\gamma_R(\Omega_S, \theta_S, P_J) = \frac{\begin{pmatrix} |h_{TR}|^2 + 2|h_{TR}||h_{SR}||h_{TS}|\Omega_S\cos \\ (\theta_{TR} - \theta_{SR} - \theta_S - \theta_{TS}) + \\ |h_{SR}|^2|h_{TS}|^2\Omega_S^2 \end{pmatrix}P_T}{|h_{SR}|^2\Omega_S^2\sigma_S^2 + |h_{JR}|^2 P_J + \sigma_R^2} \quad \text{[Equation 9]}$$

Using the above Equations 8 and 9, Equation 7 may be rewritten as below.

$$(P): \max_{\Omega_S, \theta_S, P_J} \gamma_R(\Omega_S, \theta_S, P_J) \quad \text{[Equation 10]}$$

$$\text{s.t. } \gamma_M(\Omega_S) \geq \gamma_R(\Omega_S, \theta_S, P_J)$$

$$\gamma_M(\Omega_S) \geq \overline{\gamma}_M$$

$$|h_{TS}|^2 P_T\Omega_S^2 + \sigma_S^2\Omega_S^2 \leq \overline{P}_S$$

$$0 \leq P_J \leq \overline{P}_J$$

Referring to Equation 10, it can be seen that when all the other values are fixed, the second SINR $\gamma_R$ value changes with the phase $\theta_S$ of the amplification coefficient $$\frac{G_S}{(1-G_S h_{SS})}$$

of the spoofing relay 100. Additionally, as can be seen from the third conditional expression, the magnitude $\Omega_S$ of the amplification coefficient and the transmit power have a fixed value irrespective of any change in phase $\theta_S$ In particular, where $$\theta_S = \theta_{S,max} \triangleq \theta_{TR} - \theta_{SR} - \theta_{TS},$$

$\gamma_R$ is maximized, and the spoofing signal constructively interferes with the illegal signal, thereby increasing the SINR of the illegal receiver R, namely, the second the SINR. Accordingly, this is referred to as constructive relaying.

In contrast, otherwise, where $\theta_{S,min} \leq \theta_S < \theta_{S,max}$, $$\theta_{S,max} \triangleq \theta_{TR} - \theta_{SR} - \theta_{TS} - \pi,$$

the spoofing signal destructively interferes with the illegal signal at the illegal receiver R, thereby reducing the SINR of the illegal receiver R. Accordingly, this is referred to as destructive relaying.

That is, the monitoring system 1000 using cooperative jamming and spoofing according to the present disclosure may operate in any one operation mode of a first mode for reducing the SINR of the illegal receiver R by the maximum jamming according to the amplification coefficient and the magnitude of the transmit power, a second mode for increasing the SINR of the illegal receiver R by using the jamming signal and the spoofing signal, and a third mode for increasing the SINR of the illegal receiver R by using only the spoofing signal without the jamming signal. It will be described with reference to FIG. 5 together.

Figure 5:
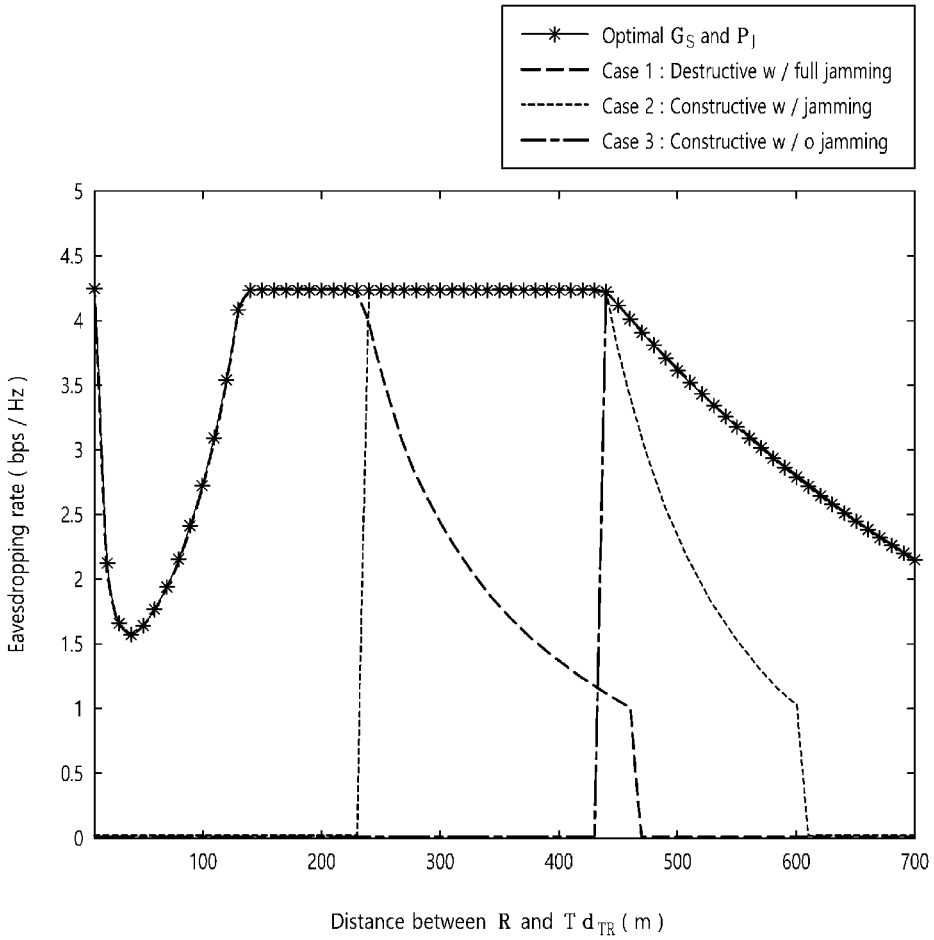
FIG. 5 is a graph showing a change in the maximum information monitoring amount as a function of the distance between an illegal transmitter and an illegal receiver.

FIG. 5 is a graph showing a change in the maximum information monitoring amount as a function of the distance between the illegal transmitter T and the illegal receiver R.

As shown, in case that the distance between the illegal transmitter T and the illegal receiver R is sufficiently short (case 1), since the maximum possible transmission speed of the illegal signal is much higher than the monitoring channel capacity, it can be seen that in this situation, both jamming signal transmission with the maximum power by the cooperative jammer 200 and destructive relaying of the spoofing relay 100 are necessary to monitor the information.

Additionally, in case that the illegal transmitter T and the illegal receiver R are located at a distance (case 2), only the jamming signal of the cooperative jammer 200 without destructive relaying of the spoofing relay 100 is enough to monitor the illegal signal.

Finally, in case that the illegal transmitter T and the illegal receiver R are relatively far away (case 3), the maximum possible transmission speed of the illegal signal is lower than the eavesdropping channel capacity. In this situation, the cooperative jammer 200 does not jam any longer and may increase the SINR of the illegal receiver R to a sufficient level to monitor by using only the constructive relaying of the spoofing relay 100 to maximize the information monitoring amount.

As described above, the monitoring system 1000 using cooperative jamming and spoofing according to the present disclosure may operate in the first mode when the phase of the amplification coefficient is equal to or greater than the minimum value and less than the maximum value ($\theta_{S,\,min} \leq \theta_S^{\bigstar} < \theta_{S,\,max}$) and the transmit power is maximum ($P_J^{\bigstar} = P_J$), may operate in the second mode when the phase of the amplification coefficient is maximum ($\theta_S^{\bigstar} = \theta_{S,\,max}$) and the transmit power of the jamming signal is $0 < P_J^{\bigstar} \leq P_J$, and may operate in the third mode when the phase of the amplification coefficient is maximum ($\theta_S^{\bigstar} = \theta_{S,\,max}$) and the transmit power is 0 ($P_J^{\bigstar} = 0$).

In this instance, the monitor 300 may calculate the amplification coefficient of the spoofing relay 100 and the transmit power of the cooperative jammer 200 so that the information monitoring amount is maximum in each operation mode.

First, when the monitoring system 1000 using cooperative jamming and spoofing according to the present disclosure operates in the first mode, the monitor 300 may calculate the amplification coefficient of the spoofing relay 100 for having the maximum information monitoring amount in the first mode. In this case, Equation 10 may be rewritten as below.

$$\begin{aligned}
&(P.1): \max_{\Omega_S, \theta_S} \gamma_R(\Omega_S, \theta_S, \overline{P}_J) \\
&\text{s.t. } \gamma_M(\Omega_S) = \gamma_R(\Omega_S, \theta_S, \overline{P}_J) \\
&\gamma_M(\Omega_S) \geq \overline{\gamma}_M \\
&|h_{TS}|^2 P_T \Omega_S^2 + \sigma_S^2 \Omega_S^2 \leq \overline{P}_S
\end{aligned} \qquad \text{[Equation 11]}$$

In this instance, the first conditional expression of Equation 11 is as below.

$$\cos(\theta_{TR} - \theta_{SR} - \theta_S - \theta_{TS}) = \frac{|h_{SM}|^2 \Omega_S^2 |h_{TS}|^2}{|h_{SM}|^2 \Omega_S^2 \sigma_S^2 + \sigma_M^2} \left( \begin{matrix} |h_{SR}|^2 \Omega_S^2 \sigma_S^2 + \\ |h_{JR}|^2 \overline{P}_J + \sigma_R^2 \end{matrix} \right) - \frac{|h_{TR}|^2 - |h_{SR}|^2 |h_{TS}|^2 \Omega_S^2}{2|h_{TR}||h_{SR}||h_{TS}|\Omega_S} \triangleq \eta(\Omega_S) \qquad \text{[Equation 12]}$$

Here, using the property that the range of the left side $\cos(\bullet)$ is $-1 \leq \cos(\bullet) \leq 1$ and the property that maximizing the second SINR $\gamma_R$ according to the equal sign of the first conditional expression is equivalent to maximizing the first SINR $\gamma_M$, Equation 11 may be simplified as below.

$$\begin{aligned}
&(P.1): \max_{\Omega_S} \Omega_S \\
&\text{s.t. } -1 \leq \eta(\Omega_S) \leq 1 \\
&\sqrt{\frac{\overline{\gamma}_M \sigma_M^2}{(|h_{TS}|^2 P_T - \gamma_M \sigma_S^2)|h_{SM}|^2}} \leq \Omega_S \leq \sqrt{\frac{\overline{P}_S}{|h_{TS}|^2 P_T + \sigma_S^2}}
\end{aligned} \qquad \text{[Equation 13]}$$

Since the range of $\Omega_S$ satisfying the first conditional expression of Equation 13 can be easily calculated in a closed-form using a formula of roots of a cubic equation, it can be seen that an optimal solution $\Omega_S^{\bigstar}$ of Equation 13 is the greatest $\Omega_S$ in the intersection of the range of $\Omega_S$ satisfying the first conditional expression and the range of the second conditional expression.

Additionally, the monitor 300 may calculate an optimal solution of $\theta_S^\star$ in a closed-form as below through the calculated $\Omega_S^\star$.

$$\theta_S^\star=\theta_{TR}-\theta_{SR}-\theta_{TS}-\cos^{-1}(\eta(\Omega_S^\star)) \quad \text{[Equation 14]}$$

To conclude, the monitor 300 may calculate the optimal amplification coefficient $G_S^\star$ having the calculated magnitude $\Omega_S^\star$ and phase $\theta_S^\star$. In this instance, since the transmit power (PJ) of the jamming signal in the first mode is fixed to the maximum transmit power as described above, the optimal transmit power in the first mode may always have a constant value.

Subsequently, when the monitoring system 1000 using cooperative jamming and spoofing according to the present disclosure operates in the second mode, the monitor 300 may calculate the transmit power of the cooperative jammer 200 for having the maximum information monitoring amount in the second mode. In this case, Equation 10 may be rewritten as below.

$$\begin{aligned}
&(P.2): \max_{\Omega_S, P_J} \gamma_R(\Omega_S, \theta_{S,max}, P_J) \quad \text{[Equation 15]}\\
&\text{s.t. } \gamma_M(\Omega_S) = \gamma_R(\Omega_S, \theta_{S,max}, P_J)\\
&\gamma_M(\Omega_S) \geq \bar{\gamma}_M\\
&|h_{TS}|^2 P_T \Omega_S^2 + \sigma_S^2 \Omega_S^2 \leq \bar{P}_S\\
&0 \leq P_J \leq \bar{P}_J
\end{aligned}$$

Additionally, the first conditional expression of Equation 15 is given as below.

$$\begin{aligned}
P_J = \quad & \text{[Equation 16]}\\
&(|h_{TR}|^2 + 2|h_{TR}||h_{SR}||h_{TS}|\Omega_S\cos(\theta_{TR} - \theta_{SR} - \theta_{S,max} - \theta_{TS}) +\\
&|h_{SR}|^2|h_{TS}|^2\Omega_S^2)\frac{|h_{SM}|^2\Omega_S^2\sigma_S^2 + \sigma_F^2}{|h_{SM}\Omega_S h_{TS}|^2|h_{JR}|^2} -\\
&\frac{|h_{SR}|^2\Omega_S^2\sigma_S^2}{|h_{JR}|^2} - \frac{\sigma_R^2}{|h_{JR}|^2} \triangleq \delta(\Omega_S)
\end{aligned}$$

Meanwhile, using the property that the range of the transmit power $P_J$ of the cooperative jammer 200 is $0 \leq P_J \leq \bar{P}$ and the property that maximizing the second SINR $\gamma_R$ according to the equal sign of the first conditional expression is equivalent to maximizing the first SINR $\gamma_M$, a simple form of Equation 15 (P.2) is as below.

$$\begin{aligned}
&(P.2): \max_{\Omega_S} \Omega_S \quad \text{[Equation 17]}\\
&\text{s.t. } 0 \leq \delta(\Omega_S) \leq \bar{P}_J\\
&\sqrt{\frac{\bar{\gamma}_M \sigma_M^2}{(|h_{TS}|^2 P_T - \bar{\gamma}_M \sigma_S^2)|h_{SM}|^2}} \leq \Omega_S \leq \sqrt{\frac{\bar{P}_S}{|h_{TS}|^2 P_T + \sigma_S^2}}
\end{aligned}$$

Since the range of $\Omega_S$ satisfying the first conditional expression of Equation 17 can be easily calculated in a closed-form using a formula of roots of a cubic equation, it can be seen that the optimal solution $\Omega_S^\star$ of Equation 17 is the greatest $\Omega_S$ in the intersection of the range of $\Omega_S$ satisfying the first conditional expression and the range of the second conditional expression.

Additionally, the monitor 300 may simply calculate an optimal solution of the transmit power in a closed-form through $P_J^\star\delta(\Omega_S^\star)$ using the calculated $\Omega_S^\star$. Here, since the amplification coefficient is always maximum in the second mode as described above, the optimal solution $\theta_S^\star$ of the phase of the amplification coefficient in the second mode is $\theta_{S,\ max}$.

Finally, subsequently, when the monitoring system 1000 using cooperative jamming and spoofing according to the present disclosure operates in the third mode, the monitor 300 may calculate the amplification coefficient of the spoofing relay 100 for having the maximum information monitoring amount in the third mode.

When the monitoring system 1000 using cooperative jamming and spoofing according to the present disclosure operates in the third mode, the optimal solution $\theta_S^\star$ of the phase of the amplification coefficient of the spoofing relay 100 is fixed to $\theta_{S,\ max}$ and the jamming signal is not generated, so the transmit power of the jamming signal may be 0, and accordingly Equation 10 may be rewritten as below.

$$\begin{aligned}
&(P.3): \max_{\Omega_S} \gamma_R(\Omega_S, \theta_{S,max}, 0) \quad \text{[Equation 18]}\\
&\text{s.t. } \gamma_M(\Omega_S) \geq \gamma_R(\Omega_S, \theta_{S,max}, 0)\\
&\gamma_M(\Omega_S) \geq \bar{\gamma}_M\\
&|h_{TS}|^2 P_T \Omega_S^2 + \sigma_S^2 \Omega_S^2 \leq \bar{P}_S
\end{aligned}$$

Through Equation 18, the range of $\Omega_S$ satisfying the first conditional expression can be easily calculated in a closed-form using a formula of roots of a cubic equation and the range of $\Omega_S$ satisfying the second and third conditional expressions may be also simply represented as $$\sqrt{\frac{\bar{\gamma}_M \sigma_M^2}{(|h_{TS}|^2 P_T - \bar{\gamma}_M \sigma_S^2)|h_{SM}|^2}} \leq \Omega_S \leq \sqrt{\frac{\bar{P}_S}{|h_{TS}|^2 P_T + \sigma_S^2}}$$

in a closed-form.

Meanwhile, it can be seen that the objective function $\gamma_R$ exhibits a monotonically increasing property on $\Omega_S < |k_{TS}|\sigma_R^2/(|h_{TR}||h_{SR}|\sigma_S^2)$ and a monotonically decreasing property on $\Omega_S = |k_{TS}|\sigma_R^2/(|h_{TR}||h_{SR}|\sigma_S^2)$ through the first derivative.

Accordingly, where $\Omega_S = |k_{TS}|\sigma_R^2/(|h_{TR}||h_{SR}|\sigma_S^2)$, $\gamma_R$ is maximum, but it can be seen that the corresponding solution through mathematical analysis does not satisfy the first conditional expression of Equation 18 and is always greater than the range of $\Omega_S$ satisfying all the conditional expressions of Equation 18.

In conclusion, it can be seen that the optimal solution $\Omega_S^\star$ of Equation 18 is the greatest $\Omega_S$ in the range of $\Omega_S$ satisfying all the conditional expressions, and all these ranges may be calculated in a closed-form as described above.

Summing up, the monitoring system 1000 using cooperative jamming and spoofing according to the present disclosure may operate in any one operation mode of the first mode for reducing the SINR of the illegal receiver by using the spoofing relay 100 and the cooperative jammer 200 in the process of monitoring the illegal signal, the second mode for increasing the SINR of the illegal receiver by using the spoofing relay 100, and the third mode for increasing the SINR of the illegal receiver by using the spoofing relay 100.

In this instance, when the monitoring system 1000 using cooperative jamming and spoofing according to the present disclosure operates in the first mode, the second mode and the third mode, the monitor 300 may calculate the amplification coefficient or the transmit power so that the information monitoring amount is maximum in each operation mode. Subsequently, the monitor 300 may select any one operation mode in which the information monitoring amount is maximum among the first mode, the second mode and the third mode, and select the amplification coefficient or the transmit power calculated in the selected mode as the amplification coefficient and the transmit power in which the information monitoring amount is maximum. Finally, the monitor 300 may transmit the selected amplification coefficient to the spoofing relay 100 to control the spoofing relay 100 to amplify the illegal signal according to the calculated amplification coefficient and relay it, or transmit the selected transmit power to the cooperative jammer 200 to control the cooperative jammer 200 to transmit the jamming signal according to the calculated transmit power.

Accordingly, the monitor 300 may recover the original optimal value of the amplification coefficient of the spoofing relay 100 to $$G_S^\star = \frac{\Omega_S^\star e^{j\theta_S^\star}}{\left(1 + \Omega_S^\star e^{j\theta_S^\star} h_{SS}\right)}$$

using the optimal solution $\Omega_S^\star$, $\theta_S^\star$ calculated through the above Equation 10.

Figure 6:
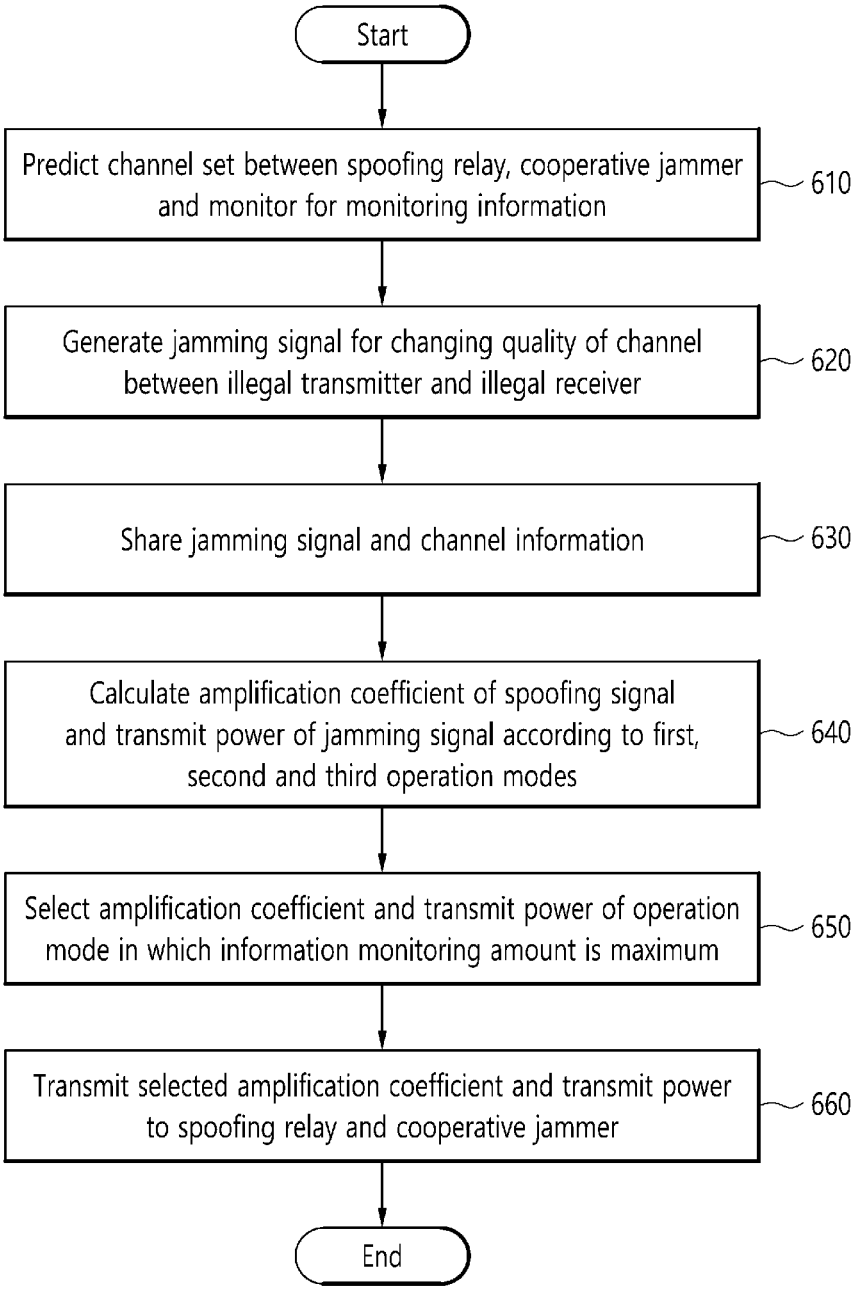
FIG. 6 is a flowchart showing a schematic flow of a wireless communication channel monitoring method using cooperative jamming and spoofing according to an embodiment of the present disclosure.

FIG. 6 is a flowchart showing a schematic flow of a monitoring method using cooperative jamming and spoofing according to an embodiment of the present disclosure.

The monitoring method using cooperative jamming and spoofing according to the present disclosure may be performed by the above-described monitoring system 1000 using cooperative jamming and spoofing as shown in FIG. 1, and each element of the monitoring system using cooperative jamming and spoofing may have software (application) installed thereon for performing each step of the monitoring method using cooperative jamming and spoofing as described below.

First, the spoofing relay 100, the cooperative jammer 200 and the monitor 300 of the monitoring system 1000 using cooperative jamming and spoofing according to the present disclosure may generate a monitoring channel for detecting an illegal signal transmitted and received between the illegal transmitter T and the illegal receiver R, and predict the condition of each generated channel (610).

That is, the spoofing relay 100 and the cooperative jammer 200 may be positioned at appropriate locations for monitoring information. In detail, the spoofing relay 100 may be positioned at a location for detecting an illegal signal generated from the illegal transmitter T and transmitting a spoofing signal to the illegal receiver R. Additionally, the monitor 300 may be positioned at a location for communicating with the spoofing relay 100 and the cooperative jammer 200. In this case, each communication channel may be formed between the spoofing relay 100 and the monitor 300, between the spoofing relay 100 and the cooperative jammer 200, and between the cooperative jammer 200 and the monitor 300, and the spoofing relay 100, the cooperative jammer 200 and the monitor 300 may predict the channel quality of each communication channel such as noise interference.

Subsequently, the cooperative jammer 200 may generate a jamming signal for changing the channel quality between the illegal transmitter and the illegal receiver (620), and the spoofing relay 100, the cooperative jammer 200 and the monitor 300 may share the generated jamming signal and information of the channel formed therebetween (630).

That is, the spoofing relay 100, the cooperative jammer 200 and the monitor 300 may share the same jamming signal grouping and jamming signal transmission sequence, and the monitor 300 and the spoofing relay 100 may cancel out jamming interference occurring from the cooperative jammer 200 during eavesdropping through prior cooperation. Additionally, the monitor 300, the spoofing relay 100 and the cooperative jammer 200 may share all channel information in advance through an effective channel measurement method.

Subsequently, when the monitoring system 1000 using cooperative jamming and spoofing according to the present disclosure operates in the first mode, the second mode and the third mode, the monitor 300 may calculate the amplification coefficient and the transmit power in each operation mode so that the monitoring amount of information acquired by recovering the illegal signal received from the spoofing relay 100 is maximum (640).

As described above, the wireless communication channel monitoring system 1000 using cooperative jamming and spoofing according to the present disclosure may operate in any one mode of a first mode in which the cooperative jammer 200 transmits the jamming signal with the maximum power and the spoofing relay 100 performs destructive relaying, a second mode in which the cooperative jammer 200 transmits the jamming signal below the maximum possible power and the spoofing relay 100 performs constructive relaying, and a third mode in which the cooperative jammer 200 does not transmit the jamming signal and the spoofing relay 100 performs constructive relaying, according to the comparison result of the monitoring channel capacity and the transmission speed of the illegal transmitter T.

In this instance, the monitor 300 may calculate the amplification coefficient of the spoofing relay 100 and the transmit power of the cooperative jammer 200 so that the information monitoring amount is maximum in each operation mode. Its detailed description is provided above, and repetitive descriptions are omitted herein.

The monitor 300 may select any one operation mode in which the information monitoring amount is maximum, and select the amplification coefficient and the transmit power in which the information monitoring amount calculated in the selected operation mode is maximum (650).

Finally, the monitor 300 may transmit the selected optimal amplification coefficient to the spoofing relay 100 and the selected optimal transmit power to the cooperative jammer 200 (650), to change the amplification coefficient of the spoofing relay 100 and the transmit power of the cooperative jammer 200 in real time so that the monitoring amount of information recovered is maximum (660). In other words, the spoofing relay 100 may amplify the spoofing signal according to the amplification coefficient set from the monitor 300 and transmit it to the illegal receiver R, and the cooperative jammer 200 may transmit the jamming signal to the illegal receiver R according to the transmit power set from the monitor 300, so that the monitoring amount of information acquired by the monitor 300 may be maximum.

While the present disclosure has been hereinabove described with reference to the embodiments, those skilled in the art will understand that various modifications and changes may be made thereto without departing from the spirit and scope of the present disclosure defined in the appended claims.

DETAILED DESCRIPTION OF MAIN ELEMENTS

1000: Monitoring system using cooperative jamming and spoofing
100: Spoofing relay
200: Cooperative jammer
300: Monitor

The invention claimed is:

1. A wireless communication channel monitoring system using cooperative jamming and spoofing to monitor information transmitted and received through a communication channel set between an illegal transmitter and an illegal receiver possessed by users using wireless communication for malicious purposes, comprising:

a spoofing relay to amplify and relay an illegal signal detected from the illegal transmitter according to a preset amplification coefficient;

a cooperative jammer to transmit a jamming signal for changing the quality of the communication channel to the illegal receiver with a preset transmit power; and a monitor to calculate the amplification coefficient and the transmit power so that the monitoring amount of information is maximum based on the illegal signal received from the spoofing relay.

2. The wireless communication channel monitoring system using cooperative jamming and spoofing according to claim 1, wherein the wireless communication channel monitoring system using cooperative jamming and spoofing operates in any one mode of a first mode in which the jamming signal is transmitted to the illegal receiver with a maximum possible transmit power and a spoofing signal is transmitted according to the amplification coefficient for reducing a Signal-to-Interference-plus-Noise Ratio (SINR) of the illegal receiver, a second mode in which the jamming signal is transmitted to the illegal receiver with the transmit power that is equal to or less than the maximum transmit power and the spoofing signal is transmitted according to the amplification coefficient for increasing the SINR of the illegal receiver, and a third mode in which the jamming signal is not transmitted to the illegal receiver and the spoofing signal is transmitted according to the amplification coefficient for increasing the SINR of the illegal receiver.

3. The wireless communication channel monitoring system using cooperative jamming and spoofing according to claim 2, wherein the monitor is configured to:

calculate the amplification coefficient for each mode and the transmit power for each mode in which the monitoring amount of information acquired by recovering the illegal signal is maximum for each of the first mode, the second mode and the third mode, extract any one mode of the first mode, the second mode and the third mode in which the monitoring amount of information is maximum, and select the amplification coefficient for each mode and the transmit power for each mode calculated in the any one extracted mode as the amplification coefficient and the transmit power in which the monitoring amount of information is maximum.

4. The wireless communication channel monitoring system using cooperative jamming and spoofing according to claim 3, wherein the monitor transmits the selected amplification coefficient to the spoofing relay and the selected transmit power to the cooperative jammer, the spoofing relay changes the preset amplification coefficient to the amplification coefficient received from the monitor, and the cooperative jammer changes the preset transmit power to the transmit power received from the monitor.

5. The wireless communication channel monitoring system using cooperative jamming and spoofing according to claim 2, wherein the wireless communication channel monitoring system using cooperative jamming and spoofing operates in any one mode of the first mode, the second mode and the third mode according to a result of comparison of a monitoring channel capacity set between the spoofing relay and the monitor and a transmission speed of the illegal transmitter determined by the SINR of the illegal receiver.

6. The wireless communication channel monitoring system using cooperative jamming and spoofing according to claim 5, wherein the wireless communication channel monitoring system using cooperative jamming and spoofing operates in the first mode for reducing the SINR of the illegal receiver to reduce the transmission speed of the illegal transmitter when the monitoring channel capacity is found smaller than the transmission speed, and the wireless communication channel monitoring system using cooperative jamming and spoofing operates in any one mode of the second mode and the third mode for increasing the SINR of the illegal receiver to increase the transmission speed of the illegal transmitter when the monitoring channel capacity is found greater than the transmission speed.

7. A wireless communication channel monitoring method using cooperative jamming and spoofing by use of a wireless communication channel monitoring system using cooperative jamming and spoofing, including a spoofing relay, a cooperative jammer and a monitor, the method comprising:

calculating, by the monitor, an amplification coefficient of the spoofing relay for each mode and a transmit power of the cooperative jammer for each mode in which a monitoring amount of information is maximum for each operation mode of the wireless communication channel monitoring system using cooperative jamming and spoofing;

extracting, by the monitor, any one operation mode in which the monitoring amount of information is maximum, and selecting the amplification coefficient for each mode and the transmit power for each mode calculated in the any one extracted operation mode as the amplification coefficient and the transmit power in which the monitoring amount of information is maximum; and transmitting the selected amplification coefficient to the spoofing relay and the selected transmit power to the cooperative jammer.

8. The wireless communication channel monitoring method using cooperative jamming and spoofing according to claim 7, wherein the wireless communication channel monitoring system using cooperative jamming and spoofing operates in any one mode of a first mode in which the jamming signal is transmitted to the illegal receiver with a maximum possible transmit power and a spoofing signal is transmitted according to the amplification coefficient for reducing a Signal-to-Interference-plus-Noise Ratio (SINR) of the illegal receiver, a second mode in which the jamming signal is transmitted to the illegal receiver with the transmit power that is equal to or less than the maximum transmit power and the spoofing signal is transmitted according to the amplification coefficient for increasing the SINR of the illegal receiver, and a third mode in which the jamming signal is not transmitted to the illegal receiver and the spoofing signal is transmitted according to the amplification coefficient for increasing the SINR of the illegal receiver.

9. The wireless communication channel monitoring method using cooperative jamming and spoofing according to claim 8, wherein calculating, by the monitor, the amplification coefficient of the spoofing relay for each mode and the transmit power of the cooperative jammer for each mode in which the monitoring amount of information is maximum for each operation mode of the wireless communication channel monitoring system using cooperative jamming and spoofing comprises:

calculating the amplification coefficient for each mode and the transmit power for each mode in which the monitoring amount of information acquired by recovering the illegal signal is maximum for each of the first mode, the second mode and the third mode, extracting any one mode of the first mode, the second mode and the third mode in which the monitoring amount of information is maximum, and selecting the amplification coefficient for each mode and the transmit power for each mode calculated in the any one extracted mode as the amplification coefficient and the transmit power in which the monitoring amount of information is maximum.

10. The wireless communication channel monitoring method using cooperative jamming and spoofing according to claim 7, further comprising:

predicting a channel set between the spoofing relay, the cooperative jammer and the monitor, and sharing the channel and a jamming signal generated in the cooperative jammer.

* * * * *